US006003439A

United States Patent [19]

Knezek et al.

[11] Patent Number: 6,003,439

[45] Date of Patent: Dec. 21, 1999

[54] MICROFLAKE GLITTER FABRICATION

[75] Inventors: Robert Alois Knezek, Arlington; James Clinton Couchman, Fort Worth; Russell Guy Torti, Arlington, all of Tex.

[73] Assignee: Lockheed Martin Corporation, Bethesda, Md.

[21] Appl. No.: 09/124,471

[22] Filed: Jul. 29, 1998

[51] Int. Cl.[6] ..... B30B 12/00; B30B 3/00

[52] U.S. Cl. ..... 100/7 R; 100/72; 100/98 R; 100/156; 100/159; 241/46.15; 241/103; 366/114; 366/127; 366/264

[58] Field of Search ..... 100/67, 70 R, 100/72, 98 R, 130, 156, 157, 159; 241/46.01, 46.04, 46.15, 46.17, 103; 366/114, 127, 262–264

[56] References Cited

U.S. PATENT DOCUMENTS

| | | | |
|---|---|---|---|
| 2,115,314 | 4/1938 | McErlean | 241/46.15 |
| 2,167,700 | 8/1939 | White | 241/103 |
| 2,183,156 | 12/1939 | Sundfelt | 241/46.15 |
| 2,353,602 | 7/1944 | Trotter | 100/70 R |
| 2,432,610 | 12/1947 | Dryer | 241/46.15 |
| 2,578,122 | 12/1951 | Beaudet | 100/159 |
| 4,002,326 | 1/1977 | Brogli et al. | 366/264 |

*Primary Examiner*—Stephen F. Gerrity

*Attorney, Agent, or Firm*—Felsman Bradley Vaden Gunter & Dillon, LLP; James E. Bradley

[57] ABSTRACT

A metallic flake manufacturing device uses a bearing to form the flakes. The bearing is located within a container which receives a fluid having suspended metallic particles. The bearing has an outer race, an inner race, and a plurality of bearings disposed between the races. The bearings are immersed in the fluid for flattening the suspended particles into flakes. A shaft extends into the container. The shaft engages one of the races for rotating it relative to the other race.

13 Claims, 2 Drawing Sheets

MICROFLAKE GLITTER FABRICATION

TECHNICAL FIELD

This invention relates in general to a process of making very small flakes for use as an additive in paints or other bulk materials. More particularly this invention relates to making very small flakes by suspending small particles in a solution that flows past smooth, polished rollers pressing against polished races where the particles are flattened by pressure between the rollers and races.

BACKGROUND ART

Very small flakes are added to materials in a fluid state, including paints, to give them unique properties. Automotive paints have very small flakes suspended in the paint to produce a glitter-type appearance. Such flakes are also useful in tailoring the spectral reflectance of paints, particularly in the visible and infrared wavelength spectrum. They have been found to be useful in improving the properties of radar absorbing materials including paints and bulk materials used to reduce the radar signature of aircraft. Unfortunately, the glitter-type appearance may be reduced by a rough surface texture of the flakes.

Prior art methods of producing very small flakes use a ball mill wherein ball bearings are used to smash metal particles. When using a ball mill, spherical particles are placed inside a container along with ball bearings. The container is then vibrated. A disadvantage of using a ball mill is that a ball mill produces random impacts on the material particles and produces flakes of random geometry and size. Flakes produced by a ball mill have irregular edges and surfaces that are roughened by pressure bonded inclusions. The ball mill process is very inefficient and may break larger flakes before they can be removed. Additionally, flakes from a ball mill process are not uniformly flat and often stick together.

DISCLOSURE OF INVENTION

In this invention, a roller bearing and bearing race are mounted in a container so that fluid having particles suspended therein passes between the roller bearing and the bearing race. Preferably, spherical particles having a diameter of 10 to 20 microns are suspended in the fluid. In one embodiment, an inner bearing race is turned by a motor driven shaft. Particles caught between the bearing rollers and bearing race are flattened into flat particles or flakes. The fluid provides lubrication for the bearings as well as a medium for transport of flattened and unflattened particles. Since flattened particles are larger in diameter than unflattened ones, the flattened particles or flakes can be removed by a filter. The degree of flattening may be controlled by adjusting the loading force acting axially on the shaft, or by adjusting the rotation velocity, or by the number of passes of the fluid through the bearing.

DETAILED DESCRIPTION OF INVENTION

Figure 1:
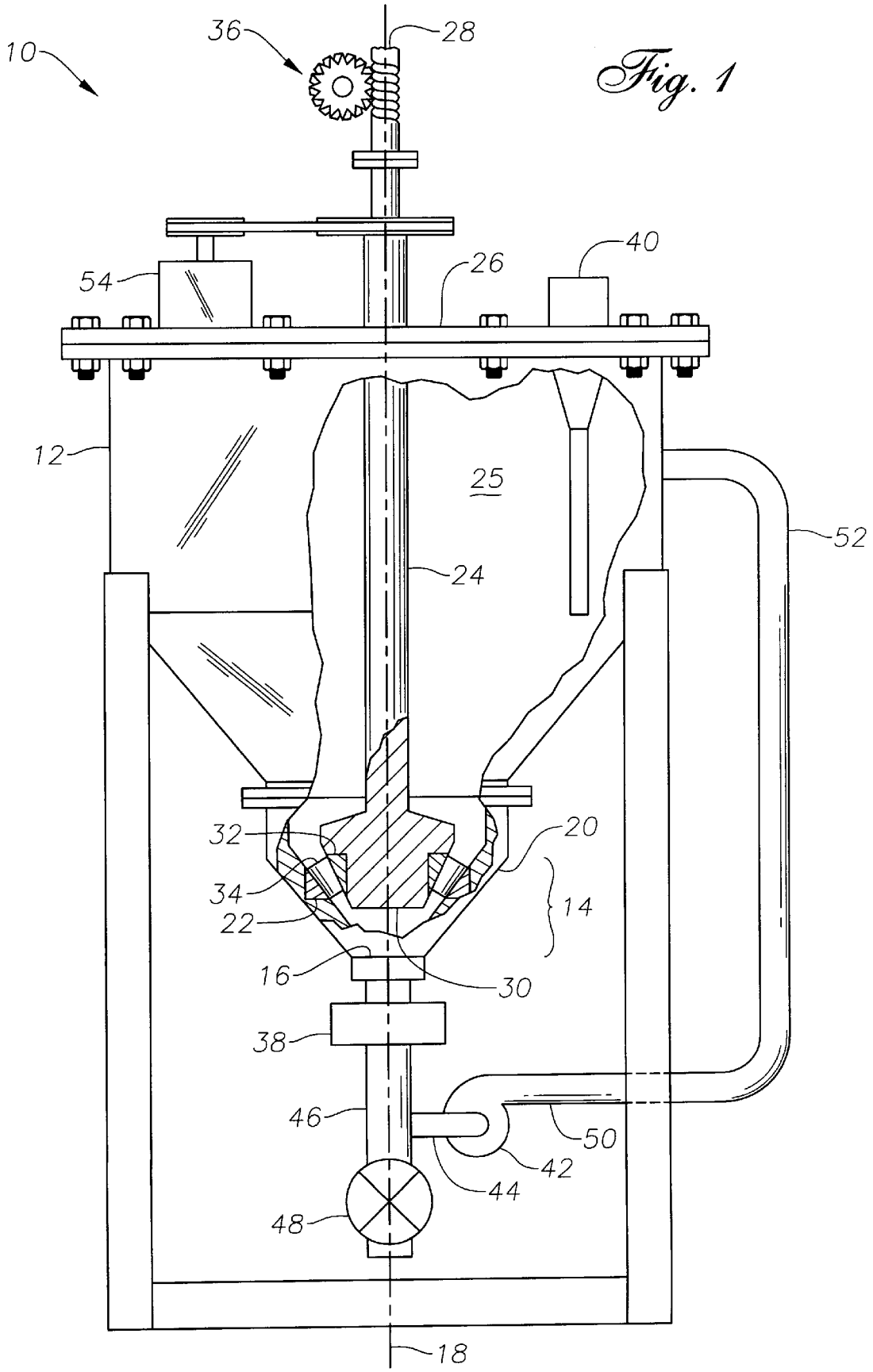
FIG. 1 is a partial sectional view of the microflake glitter mill device of the invention.

Referring to FIG. 1, a typical microflake glitter mill device is designated generally 10. Microflake glitter mill device 10 has container 12 having a frusto-conical interior section 14, outlet 16, and longitudinal axis 18. In a preferred environment, frusto-conical interior section 14 is fashioned on an interior of bearing seat 20. Bearing seat 20 is affixed to a lower portion of container 12 and is considered to be a part of container 12 for purposes of this application. Preferably, bearing seat 20 is constructed of hardened steel or an equivalent and the inclination of frusto-conical interior section 14 makes an angle of approximately 40 degrees with vertical.

Container 12 is for receiving a fluid having particles suspended therein. Outer bearing race 22 is positioned on frusto-conical interior section 14 of bearing seat 20. Shaft 24 extends into interior 25 of container 12 through lid 26 and along longitudinal axis 18. Shaft 24 has first end 28, second end 30 and is rotatable with respect to outer bearing race 22. Inner bearing race 32 is positioned on second end 30 of shaft 24. Inner bearing race 32 is complementary to outer bearing race 22. Roller bearings 34 are disposed between outer bearing race 22 and inner bearing race 32. Roller bearings 34 are for flattening the particles suspended in fluid within container 12. In a preferred embodiment, roller bearings 34 are generally cylindrical and tapered with a smaller diameter end of roller bearings 34 positioned on a lower end of the bearings.

In a preferred embodiment, force applicator 36 is provided to control the degree of particle flattening by adjusting a loading force acting axially on shaft 24. Force applicator 36 may be a rack and pinion, a desired amount of weight affixed to shaft 24 or other device for controlling a loading force acting on shaft 24 and therefore on roller bearings 34. Preferably, bearing 37 or other device is provided to allow relative rotation of shaft 28 with rack and pinion 36.

In a preferred embodiment, flake filter 38 is provided below outlet 16 so that flattened particles or flakes can be removed. Flake filter 38 is preferably a fixed pore size filter. Since flattened particles are larger in diameter than unflattened ones, a fixed pore size filter is effective for removing flattened particles. Flake filter 38 may be periodically removed from below outlet 16 to prevent clogging and so that flakes may be removed for use. Smaller, unflattened particles pass through flake filter 38 for recirculation into container 12. In a preferred embodiment, agitator 40 is provided to keep particles from sticking together or adhering to surfaces. Agitator 40 may be an ultrasonic agitator. Additionally, in a preferred embodiment, microflake glitter mill device 10 is provided with recirculation pump 42. Preferably, recirculation pump 42 has intake 44 which draws all fluids from exit tube 46. Exit tube 46 extends from outlet 16 of container 12 and accommodates flake filter 38. Valve 48 may be positioned below intake 44 so that fluids may be emptied from container 12. However, it may be desirable to locate valve 48 and position filter 38 at an upper position of recirculation tubing 52 to prevent settling of particles. Recirculation pump 42 has outlet 50 for recirculating fluids through recirculation tubing 52 back into container 12. Finally, in the preferred embodiment, microflake glitter mill device 10 is provided with motor 54 for rotating shaft 24 and inner bearing race 32 that is affixed thereto. Motor 54 may be an air motor, or other types of motors may be used to drive shaft 24.

Figure 2:
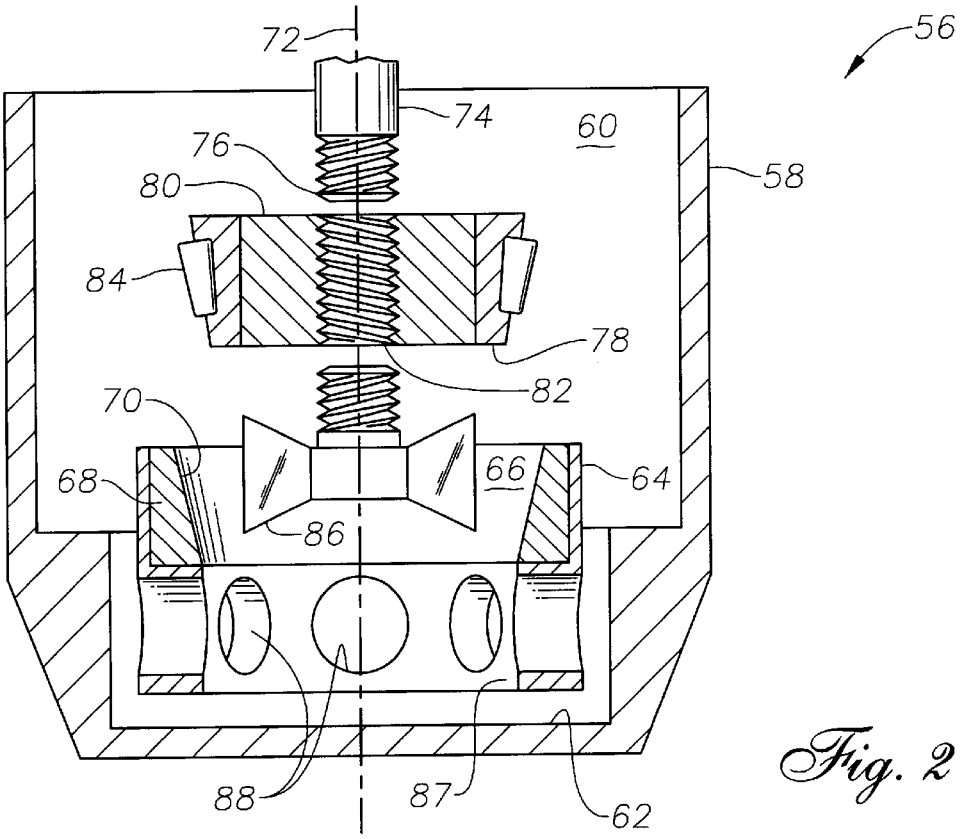
FIG. 2 is a partial sectional view of another embodiment of the microflake glitter mill device of the invention.

Referring now to FIG. 2, a second embodiment of a small laboratory microflake glitter mill device is designated generally 56. Device 56 has container 58 having interior 60 and floor 62. Container 58 is for receiving a fluid having particles suspended therein. Tube piece 64 rests on or is affixed to floor 62 of container 58. Tube piece 64 has a cylindrical interior 66 for accommodating outer bearing race 68. Outer bearing race 68 preferably has a frusto-conical interior 70 and longitudinal axis 72. Shaft 74 extends into interior 60 of container 58 along longitudinal axis 72. Shaft 74 has lower end 76. In a preferred embodiment, lower end 76 of shaft 74 is threaded. Inner bearing race 78 is affixed to shaft 74 proximate lower end 76 of shaft 74. In a preferred embodiment, inner bearing race 78 is positioned on bearing disk 80. Bearing disk 80 is preferably provided with threaded orifice 82 for threadably receiving lower end 76 of shaft 74. Tapered roller bearings 84 are disposed between outer bearing race 68 and inner bearing race 78. Roller bearings 84 are for flattening particles suspended in liquid contained within container 58. Liquid and particles flow between roller bearings 84 and outer bearing race 68. The degree of flattening may be controlled by adjusting a loading force acting axially on shaft 74. Preferably, bearing surfaces are highly polished and have accurate dimensions so that uniform particle flattening is possible. A limiting gap between roller bearings 84 and races 68 and 78 can produce particle flakes of uniform thickness.

To facilitate mixing of the liquid and particles, outer bearing race 68 is elevated above floor 62 of container 58 to accommodate impeller 86, which is preferably a paddle. In the preferred embodiment, impeller 86 is threadably received into threaded orifice 82 of bearing disk 80. Impeller 86 is located within cylindrical cavity 87 in tube piece 64 and mixes the liquid and particles within container 58. Preferably, tube piece 64 has a plurality of orifices 88 positioned in cylindrical cavity 87 below outer bearing race 68 to facilitate mixing of the fluid. Tube piece 64 and impeller 86 serve as a recirculating or inducer pump, which causes flow outward, then up and back down through the bearing. The degree of flattening is controlled by adjusting a loading force acting axially on shaft 76. Additionally, in a preferred embodiment, an agitator 40 (FIG. 1) is provided to prevent particles from sticking together or adhering to surfaces. Agitator 40 may be an ultrasonic agitator.

Figure 3:
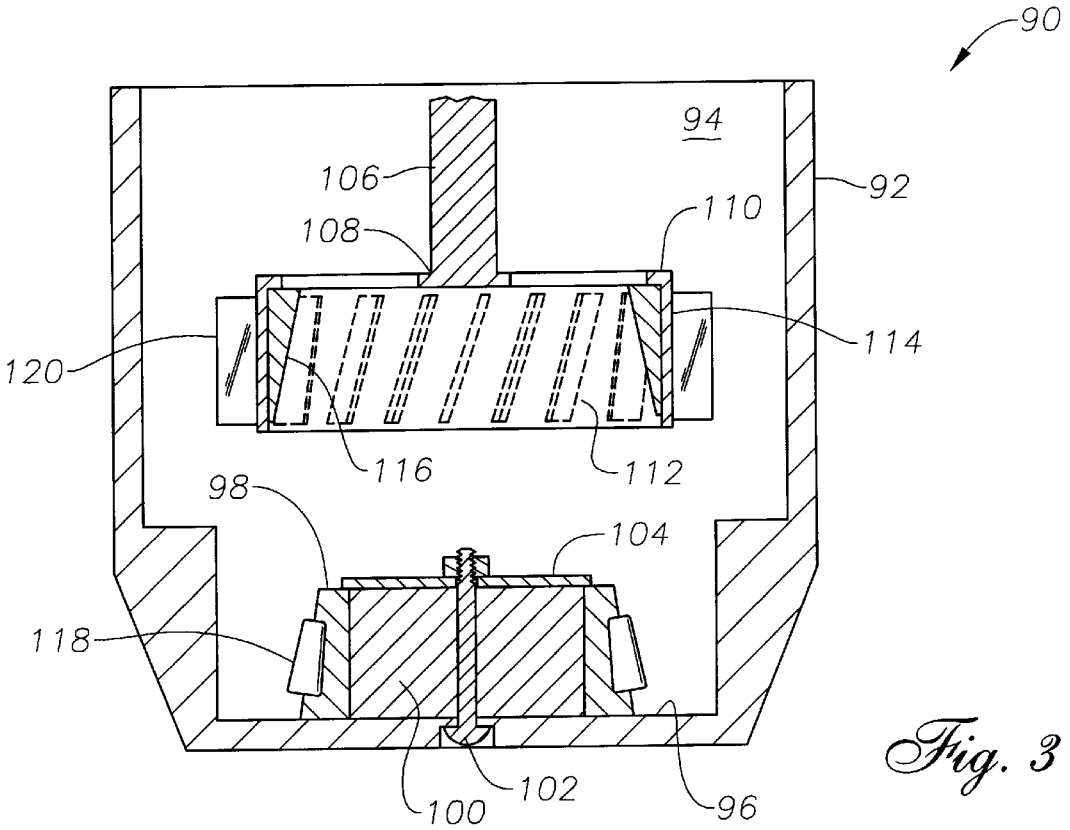
FIG. 3 is a partial sectional view of another embodiment of the microflake glitter mill device of the invention.

Referring now to FIG. 3, shown is a third embodiment of the microflake glitter mill device designated generally 90. Container 92 has interior 94 and floor 96. Container 92 is for receiving a fluid having suspended particles. Inner bearing race 98 is positioned proximate floor 96 and is preferably stationary. Inner bearing race 98 is preferably affixed to bearing spool 100, which is secured to floor 96 by nut and bolt assembly 102 and plate 104. Shaft 106 extends into interior 94 of container 92 and has lower end 108.

Fixed to lower end 108 of shaft 106 is bearing race housing 110. Bearing race housing 110 has interior 112 and exterior 114. Outer bearing race 116 is affixed to interior 112 of bearing race housing 110. Bearing race housing 110 fits over bearing disk 100 and inner bearing race 98 and is rotatable with respect thereto. Outer bearing race 116 is complimentary to inner bearing race 98. Tapered roller bearings 118 are disposed on inner bearing race 98, wherein the smaller diameter ends of roller bearings 118 are on an upper end.

Fluid having particles suspended therein passes over and between inner bearing race 98, outer bearing race 116 and roller bearings 118. As shaft 106 and bearing race housing 110 turn, roller bearings 118 flatten particles into flakes. The fluid provides lubrication for roller bearings 118 as well as a medium for transport of the flattened and unflattened particles. The degree of flattening is controlled by adjusting a loading force acting axially on shaft 106. Preferably, inner bearing race 98, outer bearing race 116 and roller bearings 118 are highly polished, having accurate dimensions to make uniform particle flattening possible. Additionally, an ultrasonic agitator may be used to keep particles from sticking together or adhering to surfaces. To facilitate circulation of fluid within interior 94 of container 92, a plurality of fins 120 are positioned on exterior 114 of bearing race housing 110. Fins 120 serve as an inducer circulation pump to assure that unflattened particles are circulated between inner bearing race 98 and outer bearing race 116 for flattening by roller bearings 118.

In practice, a method of making small flakes includes the steps of suspending small spheres in a fluid and flowing the fluid past smooth rollers such as roller bearings 34, 84 or 118, which press against smooth races such as inner bearing race 32, 78 or 98 and outer bearing race 22, 68 or 116. The particles are then flattened between the rollers and the races. In a preferred embodiment, the suspended spherical particles are approximately 0.4 to 350 microns in diameter, typically 10–20 microns in diameter. After flattening, the flakes are between 1 and 2000 microns in diameter, preferably 25–200 microns in diameter and 0.1 to 15 microns thick. It is preferred that the flattening step is controlled by applying an adjustable force on the rollers with force applicator 36. The force acting on shaft 24, 74 or 106 may be applied by a rack and pinion system, the application of weights to the shaft or other devices for applying force to the rollers via the shaft. Additionally, the degree of flattening of the particles may be controlled by the viscosity of the circulating fluid or by adjusting the rotational velocity of the rollers or the races.

The method may be a batch system wherein a shaft is rotated for a period of time before the fluid-particle mixture is changed. After the fluid-particle mixture is changed, the flakes are then separated from the mixture. Additionally, the method may also include a step of separating flattened particles from a fluid by means of a filter such as a fixed pore size filter. Further, it is desirable to circulate fluid within the container so that unflattened particles will come into contact with the roller bearing-race interface. Recirculation may be accomplished by means of a recirculation pump, a mixer such as a impeller, a fin arrangement or other devices.

The system has significant advantages. The method of the invention is a low cost method of producing sub-millimeter thin flat flakes of materials such as soft metal. The apparatus and method of the invention allow for the formulation of paints having properties determined by more uniform flakes. Paints having uniform or predictable properties may be used and designed to produce desirable optical properties, to minimize a radar image of an aircraft or for other purposes.

While the invention has been shown in only three of its forms, it should be apparent to those skilled in the art that it is not so limited but is susceptible to various changes without departing from the scope of the invention. For example, force may be applied to the shaft of the invention in a variety of ways including manual application of force by a drill motor or other means. The container of the invention may be of various shapes, and the bearing-race interface may be established in a variety of configurations including providing center rotating rollers. Additionally, various methods may be used to recirculate the fluid and particle mixture.

We claim:

1. An apparatus for making small flakes from particles, said apparatus comprising:

a container having an interior for receiving a fluid having suspended particles;

an outer bearing race positioned on said interior of said container;

an inner bearing race positioned complementary to said outer bearing race;

a plurality of bearings disposed between said outer bearing race and said inner bearing race, and immersed in said fluid for flattening said suspended particles into flakes;

a shaft extending into said container, said shaft having a first end and a second end, wherein the second end of said shaft engages one of said races and is rotatably driven relative the other of said races; and a recirculation device for causing flow to pass downward in a stream through said bearings, then up and back down through said bearings, the recirculation device comprising a plurality of vanes located downstream from the bearings.

2. The apparatus according to claim 1 wherein:

an outer race is supported on a bottom and has a lower annular extension having apertures, and an impeller that extends within said annular extension and rotates with said inner race.

3. The apparatus according to claim 1 wherein:

said vanes are mounted to the shaft and located in the container below the bearings.

4. The apparatus according to claim 1 wherein:

said vanes are laterally outward from said bearings and rotate with said shaft adjacent a wall of said housing to draw fluid down through a clearance between said bearings and then back up within said container.

5. An apparatus for making small flakes from particles, said apparatus comprising:

a container having an interior for receiving a fluid having suspended particles;

an outer bearing race positioned on said interior of said container;

an inner bearing race positioned complementary to said outer bearing race;

a plurality of bearings disposed between said outer bearing race and said inner bearing race, and immersed in said fluid for flattening said suspended particles into flakes;

a shaft extending into said container, said shaft having a first end and a second end, wherein the second end of said shaft engages one of said races and is rotatably driven relative the other of said races;

a recirculation device for causing flow to pass downward in a stream through said bearings, then up and back down through said bearings, the recirculation device comprising a plurality of vanes located downstream from the bearings; and a flake filter for receiving said fluid having suspended particles and flakes after passing through said bearings for separating particles from flakes.

6. An apparatus according to claim 5 wherein said flake filter is a fixed pore size filter which retains flakes having a minimum diameter and passes particles having a lesser diameter.

7. An apparatus for making small flakes from particles, said apparatus comprising:

a container having an interior for receiving a fluid having suspended particles;

an outer bearing race positioned on said interior of said container;

an inner bearing race positioned complementary to said outer bearing race;

a plurality of bearings disposed between said outer bearing race and said inner bearing race, and immersed in said fluid for flattening said suspended particles into flakes;

a shaft extending into said container, said shaft having a first end and a second end, wherein the second end of said shaft engages one of said races and is rotatably driven relative the other of said races;

a recirculation device for causing flow to pass downward in a stream through said bearings, then up and back down through said bearings, the recirculation device comprising a plurality of vanes located downstream from the bearings; and a recirculation pump, said recirculation pump having an intake for receiving fluid from an outlet of said container and an outlet for delivering fluid into said container.

8. An apparatus for making small flakes from particles, said apparatus comprising:

a container having an interior for receiving a fluid having suspended particles;

an outer bearing race positioned on said interior of said container;

an inner bearing race positioned complementary to said outer bearing race;

a plurality of tapered roller bearings disposed between said outer bearing race and said inner bearing race and immersed in said fluid for flattening said suspended particles into flakes;

a shaft extending into said container, said shaft having a first end and a second end, wherein the second end of said shaft engages one of said races and is rotatably driven relative the other of said races; and a recirculation device for causing flow to pass downward in a stream through said bearings, then up and back down through said bearings, the recirculation device comprising a plurality of vanes located downstream from the bearings.

9. The apparatus according to claim 8 wherein:

said outer race is supported on a bottom and has a lower annular extension having apertures and an impeller within said annular extension.

10. The apparatus according to claim 8 wherein:

said vanes are mounted to the shaft and located in the container below the bearings.

11. The apparatus according to claim 8 wherein:

said vanes are laterally outward from said bearings and rotate with said shaft adjacent a wall of said housing to draw fluid down through a clearance between said bearings and then back up within said container.

12. An apparatus for making small flakes from particles, said apparatus comprising:

a container having an interior and a floor, said container for receiving a fluid having suspended particles;

an inner bearing race positioned on said floor of said container, said inner bearing race having a longitudinal axis;

a shaft extending into said container along said longitudinal axis, said shaft having a lower end;

a bearing race housing having an interior and an exterior, said bearing race housing affixed to said lower end of said shaft;

an outer bearing race positioned on said interior of said bearing race housing, said outer bearing race for rotation proximate said inner bearing race; and a plurality of tapered roller bearings disposed between said outer bearing race and said inner bearing race, said roller bearings for flattening said suspended particles into flakes.

13. An apparatus according to claim 12 further comprising a plurality of fins positioned on said exterior of said bearing race housing for mixing the fluid.

* * * * *